US006455491B2

(12) United States Patent
Bauer et al.

(10) Patent No.: US 6,455,491 B2
(45) Date of Patent: Sep. 24, 2002

(54) GRANULAR ALKALI METAL PHYLLOSILICATE COMPOUND

(75) Inventors: Harald Bauer, Kerpen; Josef Holz; Günther Schimmel, both of Erftstadt, all of (DE)

(73) Assignee: Clariant GmbH, Frankfurt (DE)

( * ) Notice: Subject to any disclaimer, the term of this patent is extended or adjusted under 35 U.S.C. 154(b) by 80 days.

(21) Appl. No.: 09/738,583

(22) Filed: Dec. 15, 2000

(30) Foreign Application Priority Data

Dec. 16, 1999 (DE) ..... 199 60 744

(51) Int. Cl.[7] ..... C11D 3/08; C11D 3/40

(52) U.S. Cl. ..... 510/511; 510/276; 510/334; 510/446; 510/445; 510/531

(58) Field of Search ..... 510/511, 276, 510/334, 446, 445, 531

(56) References Cited

U.S. PATENT DOCUMENTS

| | | | | | |
|---|---|---|---|---|---|
| 4,664,839 | A | | 5/1987 | Rieck | 252/175 |
| 4,820,439 | A | | 4/1989 | Rieck | 252/135 |
| 5,356,607 | A | | 10/1994 | Just | 423/334 |
| 5,460,747 | A | * | 10/1995 | Gosselink et al. | 252/186.38 |
| 5,614,161 | A | | 3/1997 | Wilkens et al. | 423/332 |
| 5,798,331 | A | * | 8/1998 | Anderson et al. | 510/501 |
| 5,827,813 | A | * | 10/1998 | Hartman et al. | 510/443 |
| 6,114,297 | A | * | 9/2000 | Yamaguchi et al. | 510/351 |
| 6,221,820 | B1 | * | 4/2001 | Lietzmann et al. | 510/224 |
| 6,242,403 | B1 | * | 6/2001 | Lammers et al. | 510/294 |
| 6,310,028 | B1 | * | 10/2001 | Janssen | 510/446 |

FOREIGN PATENT DOCUMENTS

| | | |
|---|---|---|
| DE | 199 25 928 | 1/2000 |
| EP | 0 164 514 | 12/1985 |
| EP | 0 849 355 | 6/1998 |
| WO | WO 91/08171 | 6/1991 |

OTHER PUBLICATIONS

U.S. Patent Application No. 08/994,479.
U.S. Patent Application No. 09/346,427.

* cited by examiner

*Primary Examiner*—Charles Boyer
(74) *Attorney, Agent, or Firm*—Richard P. Silverman

(57) ABSTRACT

The invention relates to a granular alkali metal phyllosilicate compound which comprises a crystalline alkali metal phyllosilicate, a colorant and an additive. The invention also relates to a process for its preparation, and to detergents and cleaners which comprise such a granular alkali metal phyllosilicate compound.

12 Claims, No Drawings

GRANULAR ALKALI METAL PHYLLOSILICATE COMPOUND

BACKGROUND OF THE INVENTION

1. Field of the Invention

The invention relates to a granular alkali metal phyllosilicate compound, to a process for its preparation, and to detergents and cleaners which comprise such a granular alkali metal phyllosilicate compound.

DE 199 43 237 A1 describes cellulose-containing cogranulates of alkali metal phyllosilicates and disintegrants, which can optionally be colored. These cogranulates are used as detergent builders.

Detergent builders fulfill a large number of functions. Of these, particular mention may be made of the removal of or reduction in water hardness and the supplying of alkalinity, i.e. the increasing of the pH in the wash liquor. The removal of the water hardness present in mains water is important since, at the customary, in particular relatively high, washing temperatures, it causes inorganic incrustations on heating elements, walls of the washing machine and on textiles, and causes the anionic surfactants frequently used to precipitate out in the form of so called lime soaps. Firstly, this results in a decrease in detergency and, secondly, produces a gray haze on the laundry after just a few wash cycles. Inorganic incrustations consist of water hardness precipitated out in the form of calcium carbonate or of deposited residues of undissolved detergent builder components. The (desired) increase in the pH in the wash liquor results in the soil particles receiving a higher surface charge and therefore being easier to remove from the fabric.

According to the prior art, detergent constituents, this applies in particular to the builder component, are colored for various purposes by adding colorants. A particularly high color strength of the product can only be achieved here by increasing the colorant proportion accordingly. In this connection, a disadvantage is that residues of the colorants can remain in the wash liquor and lead to the tingeing of textiles and/or pollution of the environment. Surprisingly, we have now found that alkali metal phyllosilicates can be colored in a particularly color-intensive manner by appropriate choice of additives in combination with colorants without significantly increasing the proportion of colorant in the product.

2. Summary of the Invention

The object of the present invention is therefore to provide a granular alkali metal phyllosilicate compound which has particularly high color intensity relative to the prior art.

This object is achieved by a granular alkali metal phyllosilicate compound of the type mentioned in the introduction, which comprises a crystalline alkali metal phyllosilicate, a colorant and an additive.

DESCRIPTION OF THE PREFERRED EMBODIMENTS

The granular alkali metal phyllosilicate compound according to the invention preferably comprises 68–99.79% by weight of alkali metal phyllosilicate 0.01–2% by weight of colorant 0.1–15% by weight of additives 0.1–15% by weight of water.

The granular alkali metal phyllosilicate compound according to the invention particularly preferably comprises 84–98.95% by weight of alkali metal phyllosilicate 0.05–1% by weight of colorant 0.5–5% by weight of additives 0.5–10% by weight of water.

Preferred alkali metal phyllosilicates which can be used advantageously for the preparation of the compound according to the invention are those of the formula $NaMSi_xO_{2x+1}\bullet yH_2O$, where M is sodium or hydrogen, x is a number from 1.9 to 4, and y is a number from 0 to 20, and preferred values for x are 2, 3 or 4. Phyllosilicates of this type are described in EP-B-0 164 514, to which reference is expressly made here. Preferred phyllosilicates are those in which M is sodium and x assumes the values 2 or 3. In particular, both beta- and delta-sodium disilicates $Na_2Si_2O_5\bullet yH_2O$ are preferred, where beta-sodium disilicate can, for example, be obtained by the process described in WO-A-91/08171. Beta-sodium disilicate is available commercially under the name SKS-7 and delta-sodium disilicate is commercially available under the name ™SKS-6 (products from Clariant GmbH).

Further phyllosilicates which can preferably be used for the preparation of the granular alkali metal phyllosilicate compound according to the invention are described in DE-A-198 30 591. This is a finely divided crystalline sheet sodium disilicate of the formula $NaMSi_xO_{2x+1}\bullet yH_2O$, where M is sodium or hydrogen, x is a number from 1.9 to 4, and y is a number from 0 to 20, which has a content of from 0 to 40% by weight of alpha-disodium disilicate, 0 to 40% by weight of beta-disodium disilicate, 40 to 100% by weight of delta-disodium disilicate and 0 to 40% by weight of amorphous fractions and a screen oversize residue of less than 60%, and is free from sodium metasilicate.

DE-A-196 01 063 describes a crystalline sodium phyllosilicate of the formula $xNa_2O^*ySiO_2^*zP_2O_5$ with an x:y ratio of from 0.35 to 0.6, an x:z ratio of from 1.75 to 1200 and a y:z ratio of from 4 to 2800. These phosphorus-containing phyllosilicates, which have a high degree of crystallinity and a very high calcium-binding capacity, are likewise preferably used for the preparation of the compound according to the invention.

Also used according to the invention are crystalline alkali metal phyllosilicates of the formula $$a\ M'_2O\bullet b\ EO_2\bullet c\ X_2O_5\bullet d\ ZO_3\bullet SiO_2\bullet e\ H_2O,$$

in which M' is an alkali metal, E is an element of the fourth main group, X is an element of the fifth main group and Z is an element of the sixth main group of the Periodic Table of the Elements, and the following also apply:

$$0.25 \leqq a \leqq 6.25$$

$$2.5\cdot 10^{-4} \leqq b \leqq 5.63$$

$$0 \leqq c \leqq 2.81$$

$$0 \leqq d \leqq 5.63$$

$$0 \leqq e \leqq 15.3$$

In this connection, preferred crystalline alkali metal phyllosilicates are those which have a certain content of phosphorus, sulfur and/or carbon.

Suitable silicates are, however, also highly alkaline crystalline sodium silicates of the composition $$Na_2O^*xSiO_2^*yH_2O$$

where x is a number between 1.2 and 2.1, and y is a number between 0 and 20, and highly alkaline crystalline sodium silicate consists of 70 to 98% by weight of sheet disodium disilicates and of 2 to 30% by weight of non-phyllosilicatic sodium silicates of the formula $$Na_2O*vSiO_2*wH_2O$$

in which v is a number between 0.05 and 2 and w is a number between 0 and 20.

Finally, preference is also given to using sparingly soluble alkali metal silicates which comprise alkali metal phyllosilicates in finely distributed form in a nonphyllosilicatic alkali metal silicate environment of the formula x $M'_2O \bullet ySiO_2$, in which M' is an alkali metal and y/x is (1.9 to 500):1. Here, the alkali metal silicate corresponds overall to the formula $$a\ M'_2O \bullet b\ M''O \bullet cX_2O_3 \bullet dZ_2O_5 \bullet eSiO_2 \bullet fH_2O$$

in which M' is an alkali metal, M" is an alkaline earth metal, X is an element of the third main group and Z is an element of the fifth main group of the Periodic Table of the Elements and the following also apply:

$$0 \leqq a \leqq 1;$$

$$0 \leqq b \leqq 0.5;$$

$$0 \leqq c/e \leqq 0.05;$$

$$0 \leqq d/e \leqq 0.25;$$

$$1.9 \leqq e \leqq 4;$$

$$0 \leqq f \leqq 20$$

Preference is given here to those sparingly soluble alkali metal silicates which have a certain content of alkaline earth metal ions (magnesium and/or calcium), boron and/or phosphorus.

Suitable colorants are preferably oxidation-stable and/or alkali-stable dyes, and pigments. Suitable dyes can primarily be the Sandolan types (S. Blau E-HRL 180 (blue), S. NBG125 (brilliant red), S. MFBL (green)) or else Vitasin types (V. ponceau 4RC82 (red), V. chinolingelb 70 (yellow) and Telon types (Telon Blau AFN (blue), DyStar Textilfarben). It is also possible to use pigments such as Patentblau (patent blue) (DyStar), Unisperse types or Terasil-T types (both Ciba).

The additives are preferably alkyl alkoxylates, gluconamides, alkyl polyglycosides, alkyl ester alkoxylates, oligoglycols, polyglycols, monoalkyl glycol ethers, monoalkyl oligoglycol ethers, monoalkyl polyglycol ethers, dialkyl glycol ethers, dialkyl oligoglycol ethers, dialkyl polyglycol ethers, oligocarboxylates and/or polycarboxylates.

The alkyl alkoxylates are particularly preferably alkyl ethoxylates and/or EO-PO-alkoxylates.

In selecting the additive, it is to be ensured that low molecular weight compounds in particular should preferably contain at least one alkyl group. Important compounds with this feature are also nonionic surfactants.

Particularly preferred additives are alkyl alkoxylates, gluconamides and alkyl polyglycosides. Of the alkyl alkoxylates, preference is given to using ethoxylated, in particular primary alcohols having, preferably, 8 to 22 carbon atoms and, on average, 1 to 80 EO per mole of alcohol, in which the alcohol radical may be linear or, preferably, methyl-branched in the 2-position, or can contain linear and methyl-branched radicals in a mixture, as are customarily present in oxo alcohol radicals. Preferred ethoxylated alcohols include, for example, $C_{11}$-alcohols having 3, 5, 7, 8 or 11 EO, $C_{12}$–$C_{15}$ alcohols having 3, 6, 7, 8, 10 or 13 EO, $C_{14}$–$C_{15}$ alcohols having 4, 7 or 8 EO, $C_{16}$–$C_{18}$ alcohols having 8, 11, 15, 20, 25, 50 or 80 EO and mixtures thereof. The degrees of ethoxylation given are statistical mean values which, for a specific product, can be an integer or a fraction. In addition to these, it is also possible to use fatty alcohol EO/PO adducts, such as the Genapol grades 3970, 2909, and 2822.

A further embodiment of the invention is to use polyethylene glycols as additives, e.g. the PEG grades 200, 300, 400, 600, 1000, 1350, 1500, 2000, 3000, 4000, 6000, 8000, 10,000, 12,000, 20,000 and 35,000 from Clariant.

As additives, preference is also given to using monoalkyl glycol ethers, monoalkyl oligoglycol ethers or monoalkyl polyglycol ethers, including butyl glycol, butyl diglycol and butyl polyglycol. Preference is also given to using monoalkyl propylene glycols, monoalkyl oligopropylene glycols and monoalkyl polypropylene glycols.

A further embodiment of the invention provides for polycarboxylate copolymers in acidic or alkali metal form, preferably sodium form, based on acrylic acid/maleic acid (for example Sokalan grades from BASF) to be used as additives.

The additive is preferably used in a mixture or solution with water. This achieves a larger volume of liquid, which is favorable for a more uniform distribution of the additive on the initial charge of coarse alkali metal phyllosilicate. In order to ensure good handleability of the additive/water mixture (pumpability, viscosity) it may be useful to use a solubility promoter. Alcohols are particularly suitable for this purpose, particularly preferably ethanol and isopropanol.

Preferably, the additive can also be mixed in pure form with the initial charge of coarse alkali metal phyllosilicate.

The water content of the granular alkali metal phyllosilicate compound according to the invention is variable within wide limits and is limited essentially by the flowability of the final compound which is to be maintained.

The color intensity is a particularly important parameter which has an effect on the product. The color intensity of the granular alkali metal phyllosilicate compound according to the invention is, in addition to other influences, dependent on the colorant concentration. In the preferred range of from 0.01 to 2% of blue colorant, a b value of from −15 to −40 is preferred, and in the particularly preferred range of from 0.05 to 1%, a b value of from −17 to −30 is preferred.

Also important for the granular alkali metal phyllosilicate compound according to the invention are a certain particle size and a particle size distribution which, as far as possible, is not too broad. The fine particle fraction should not be too large in order to produce the greatest possible color contrast to the remaining ingredients in the subsequent detergent. Too high a fine particle fraction would produce a faded background shade.

Preference is given to an average particle diameter of from 400 to 900 $\mu$m. Here, the fraction greater than 1.4 mm is from 0.1 to 15%, and the fraction smaller than 0.25 mm is from 0.5 to 20%. Particular preference is given to an average particle diameter of from 0.5 to 0.8 mm, a fraction greater than 1.4 mm of from 1 to 9% and a fraction smaller than 0.25 mm of from 1 to 15%.

The colored granular alkali metal phyllosilicate compounds according to the invention are very readily flowable, preferably freely flowable and do not display a particular tendency toward caking.

For economical use of the colorant, only an external coloring is preferred. To prepare the granular alkali metal phyllosilicate compound according to the invention, therefore, it is preferred to start from a coarse phyllosilicate. This can either be a specifically screened fraction from phyllosilicate powder, or phyllosilicate compacted to give a granulate. Furthermore, it is also possible to use agglomerated powder. The agglomeration agent used here may be a polycarboxylate copolymer, as is described in EP-A-0 849 355.

The most important feature of the coarse alkali metal phyllosilicate (starting material) is the particle size and particle size distribution. Preference is given to an average particle diameter of from 0.5 to 0.9 mm, a fraction greater than 1.18 mm of from 0.1 to 50% and a fraction smaller than 0.25 mm of from 0.1 to 10%. Particular preference is given to an average particle diameter of from 0.5 to 0.8 mm, a fraction greater than 1.18 mm of from 1 to 10% and a fraction smaller than 0.25 mm of from 0.2 to 5%.

For the use as coarse alkali metal phyllosilicate, compressed granulates are preferred. These are preferably prepared by the methods of roll compaction, briquetting and others. In the case of roll compaction, a compaction pressure of from 10 kN/cm to 100 kN/cm is preferred and a compaction pressure of from 30 kN/cm to 80 kN/cm is particularly preferred. If desired, up to 10% by weight of granulation auxiliaries (for example water, water glass, polyethylene glycol, nonionic surfactants, anionic surfactants, polycarboxylate copolymers) can be added.

For the use as coarse alkali metal phyllosilicate, agglomerates are preferred. These are preferably prepared in particle-constructing mixers, e.g. in Lödige plowshare mixers, Eyrich mixers, Schugi mixers with downstream fluidized-bed dryer, etc. If desired, granulation auxiliaries (up to 30% by weight) or other detergent ingredients can be added here, such as water, water glass, polyethylene glycol, nonionic surfactants, anionic surfactants, polycarboxylate copolymers, soil-release polymers and others.

For the preparation of the coarse alkali metal phyllosilicate by agglomeration, alkali metal phyllosilicate is preferably finely ground (to $d_{50} \leqq 50$ $\mu$m). Examples of suitable apparatuses for this purpose are: ball mills, pendulum roller mills, roller mills, air-jet mills, hammer mills and impact mills. If desired, granulation auxiliaries can be added. Particular preference is also given to using standard powders ($50 \leqq d_{50} \leqq 500$ $\mu$m). Preferably, the abovementioned compressed granulates can also be finely ground (to $d_{50} \leqq 50$ $\mu$m).

The present invention also relates to a process for the preparation of a granular alkali metal phyllosilicate compound, which comprises mixing an alkali metal phyllosilicate with a colorant and then spraying on an additive and, if desired, afterdrying.

Here, the additive is preferably sprayed on in a mixture with water and/or a solubility promoter and, if desired, afterdried.

Finally, the present invention also relates to a detergent and cleaner comprising a granular alkali metal phyllosilicate compound according to the invention.

The detergent and cleaner preferably comprises 0.1 to 80% by weight of the granular alkali metal phyllosilicate compound 0 to 92% by weight of cobuilders 0 to 37% by weight of surfactant 0 to 53% by weight of bleaching-active agents 0 to 30% by weight of further phyllosilicate 0 to 46% by weight of electrolyte donor.

The detergent and cleaner is preferably in tablet form.

For the preparation of the granular alkali metal phyllosilicate compound according to the invention from coarse alkali metal phyllosilicate, colorant and additive, preference is given to employing mixers and conditions which are suitable for only changing the initial particulate structure of the phyllosilicate as little as possible. Particular attention must be paid to increasing the fines fraction smaller than 250 $\mu$m only as little as possible. For this purpose, preference is given to using mixers from Schugi-Hosokawa (e.g. Flexomix 160 model), preferably with downstream batch fluidized bed in order to be able to set the water content in a targeted manner.

Further suitable mixers are mixers from the companies Hauff and Telschig, which operate according to the freefall principle, and from Nauta, in which the material to be mixed is circulated by a screw in accordance with the Archimedes principle.

The colorant is preferably premixed dry with the coarse phyllosilicate. Thereafter, the additive, optionally in a mixture with water and/or solubility promoters, is sprayed on.

A further preferred embodiment is to dissolve the colorant in the additive itself, in a mixture of additive and water, or a mixture of additive, water and solubility promoter. This colorant solution is sprayed onto the pure coarse alkali metal phyllosilicate and mixed in.

It is also particularly preferred to meter in the three components coarse alkali metal phyllosilicate, colorant and additive, the last-mentioned optionally in a mixture with solubility promoters and/or water, each on its own but all at the same time into the mixer. This is preferably carried out in a mixer from Schugi-Hosokawa or from Hauff.

As already described above, the invention also relates to a detergent and cleaner which comprises a granular alkali metal phyllosilicate compound according to the invention. The compositions listed below represent an illustrative selection thereof.

The detergent and cleaner preferably comprises 0.1 to 80% by weight of the granular alkali metal phyllosilicate compound according to the invention ad 100% by weight of further customary ingredients.

The detergent and cleaner preferably comprises 0.5 to 15% by weight of the granular alkali metal phyllosilicate compound according to the invention ad 100% by weight of further customary ingredients.

The detergent and cleaner preferably comprises 1 to 9% by weight of the granular alkali metal phyllosilicate compound according to the invention ad 100% by weight of further customary ingredients.

The detergent and cleaner preferably comprises 0.1 to 80% by weight of the granular alkali metal phyllosilicate compound according to the invention 0 to 92% by weight of cobuilders ad 100% by weight of further customary ingredients.

The detergent and cleaner preferably comprises 0.5 to 15% by weight of the granular alkali metal phyllosilicate compound according to the invention 9 to 75% by weight of cobuilders ad 100% by weight of further customary ingredients.

The detergent and cleaner preferably comprises 1 to 9% by weight of the granular alkali metal phyllosilicate compound according to the invention 12.5 to 62% by weight of cobuilders ad 100% by weight of further customary ingredients.

The detergent and cleaner preferably comprises 0.1 to 80% by weight of the granular alkali metal phyllosilicate compound according to the invention 0 to 37% by weight of surfactant ad 100% by weight of further customary ingredients.

The detergent and cleaner preferably comprises 0.5 to 15% by weight of the granular alkali metal phyllosilicate compound according to the invention 1.5 to 31% by weight of surfactant ad 100% by weight of further customary ingredients.

The detergent and cleaner preferably comprises 1 to 9% by weight of the granular alkali metal phyllosilicate compound according to the invention 2 to 19% by weight of surfactant ad 100% by weight of further customary ingredients.

The detergent and cleaner preferably comprises 0.1 to 80% by weight of the granular alkali metal phyllosilicate compound according to the invention 0 to 53% by weight of bleaching-active agents ad 100% by weight of further customary ingredients.

The detergent and cleaner preferably comprises 0.5 to 15% by weight of the granular alkali metal phyllosilicate compound according to the invention 1 to 23% by weight of bleaching-active agents ad 100% by weight of further customary ingredients.

The detergent and cleaner preferably comprises 1 to 9% by weight of the granular alkali metal phyllosilicate compound according to the invention 5 to 20% by weight of bleaching-active agents ad 100% by weight of further customary ingredients.

The detergent and cleaner preferably comprises 0.1 to 80% by weight of the granular alkali metal phyllosilicate compound according to the invention 0 to 50% by weight of further phyllosilicate ad 100% by weight of further customary ingredients.

The detergent and cleaner preferably comprises 0.5 to 15% by weight of the granular alkali metal phyllosilicate compound according to the invention 4 to 30% by weight of further phyllosilicate ad 100% by weight of further customary ingredients.

The detergent and cleaner preferably comprises 1 to 9% by weight of the granular alkali metal phyllosilicate compound according to the invention 5 to 20% by weight of further phyllosilicate ad 100% by weight of further customary ingredients.

The detergent and cleaner preferably comprises 0.1 to 80% by weight of the granular alkali metal phyllosilicate compound according to the invention 0 to 46% by weight of electrolyte donor ad 100% by weight of further customary ingredients.

The detergent and cleaner preferably comprises 0.5 to 15% by weight of the granular alkali metal phyllosilicate compound according to the invention 4 to 34% by weight of electrolyte donor ad 100% by weight of further customary ingredients.

The detergent and cleaner preferably comprises 1 to 9% by weight of the granular alkali metal phyllosilicate compound according to the invention 6 to 23% by weight of electrolyte donor ad 100% by weight of further customary ingredients.

The detergent and cleaner preferably comprises 0.1 to 80% by weight of the granular alkali metal phyllosilicate compound according to the invention 0 to 92% by weight of cobuilders 0 to 37% by weight of surfactant ad 100% by weight of further customary ingredients.

The detergent and cleaner preferably comprises 0.5 to 15% by weight of the granular alkali metal phyllosilicate compound according to the invention 9 to 75% by weight of cobuilders 1.5 to 31% by weight of surfactant ad 100% by weight of further customary ingredients.

The detergent and cleaner preferably comprises 1 to 9% by weight of the granular alkali metal phyllosilicate compound according to the invention 12.5 to 62% by weight of cobuilders 2 to 19% by weight of surfactant ad 100% by weight of further customary ingredients.

The detergent and cleaner preferably comprises 0.1 to 80% by weight of the granular alkali metal phyllosilicate compound according to the invention 0 to 92% by weight of cobuilders 0 to 53% by weight of bleaching-active agents ad 100% by weight of further customary ingredients.

The detergent and cleaner preferably comprises 0.5 to 15% by weight of the granular alkali metal phyllosilicate compound according to the invention 9 to 75% by weight of cobuilders 1 to 23% by weight of bleaching-active agents ad 100% by weight of further customary ingredients.

The detergent and cleaner preferably comprises 1 to 9% by weight of the granular alkali metal phyllosilicate compound according to the invention 12.5 to 62% by weight of cobuilders 5 to 20% by weight of bleaching-active agents ad 100% by weight of further customary ingredients.

The detergent and cleaner preferably comprises 0.1 to 80% by weight of the granular alkali metal phyllosilicate compound according to the invention 0 to 92% by weight of cobuilders 0 to 37% by weight of surfactant 0 to 53% by weight of bleaching-active agents ad 100% by weight of further customary ingredients.

The detergent and cleaner preferably comprises 0.5 to 15% by weight of the granular alkali metal phyllosilicate compound according to the invention 9 to 75% by weight of cobuilders 1.5 to 31% by weight of surfactant 1 to 23% by weight of bleaching-active agents ad 100% by weight of further customary ingredients.

The detergent and cleaner preferably comprises 1 to 9% by weight of the granular alkali metal phyllosilicate compound according to the invention 12.5 to 62% by weight of cobuilders 2 to 19% by weight of surfactant 5 to 20% by weight of bleaching-active agents ad 100% by weight of further customary ingredients.

The cobuilders are preferably crystalline aluminosilicates, mono-, oligo or polymeric carboxylic acids, phosphonates, alkali metal carbonates, alkali metal hydroxides, alkali metal orthophosphates, alkali metal pyrophosphates, alkali metal polyphosphates, crystalline alkali metal silicates with a crystal lattice without a sheet structure and/or solid or liquid amorphous alkali metal silicates.

The bleaching-active agents are perborate, percarbonate, persulfate, bleach activators (e.g. TAED, nitrile quats), bleach catalysts, organic peroxides and/or enzymes. Examples of suitable enzymes are oxidases, peroxidases and reductases.

The surfactants are preferably anionic, cationic, nonionic and/or zwitterionic surfactants.

The electrolyte donors are preferably, for example, sulfates, nitrates, chlorates, perchlorates, chlorides, acetates, formates, lactates, tosylates and/or borates.

The further phyllosilicates are preferably alkali metal phyllosilicates having the chemical composition according to the prior art which are not present in the granular alkali metal phyllosilicate compound according to the invention. They are particularly preferably in compaction-granulated form, standard powder form, in the form of finely ground powder or in finely ground granulate form. They may particularly preferably also be present in compounds with copolymers, anionic or nonionic surfactants, etc.

In the case of the abovementioned detergents and cleaners, the granular alkali metal phyllosilicate compound according to the invention can preferably be present in amounts from 0.1 to 80% by weight, particularly preferably from 0.5 to 15% by weight or from 1 to 9% by weight.

The granular alkali metal phyllosilicate compounds according to the invention can be used according to the invention in detergents and cleaners. The abovementioned detergents and cleaners, water softeners and machine dishwashing detergents can be used in powder form, granulate form and tablet form.

The granular alkali metal phyllosilicate compounds according to the invention produce colored particles in pulverulent detergents and cleaners.

Preference is given here to pulverulent heavy-duty detergents, color detergents and specialty detergents. Heavy-duty detergents are balanced formulations with the aim of as high a detergency as possible. Color detergents are intended primarily to protect colored textiles with regard to bleaching and fading of the colors and felting of the fibers. Specialty detergents are aimed at narrow areas of application, such as stain-removal salts, curtain detergents, wool detergents and others.

The granular alkali metal phyllosilicate compounds according to the invention can also be used in water softeners which, primarily in regions of high water hardness, have a performance-enhancing effect on the wash result and a protective effect with regard to the washing machine.

Further applications for the granular alkali metal phyllosilicate compounds according to the invention are machine dishwashing detergents. They are suitable here primarily because of their good soil dispersion, their high alkalinity and their excellent protective effect against corrosion of glassware. For machine dishwashing detergent applications, preference is given to using weakly foaming EO/PO adducts as additives.

Preference is also given to tablet-shaped detergents and cleaners, e.g. heavy-duty detergents, color detergents, specialty detergents, machine dishwashing detergents, stain-removal salts and/or water softeners. The granular alkali metal phyllosilicate compounds according to the invention produce colored flecks in tablet-shaped detergents and cleaners. A further embodiment, in multiphase tabs, is to provide only individual parts of the tablet with flecks or to predominantly or completely homogeneously color individual parts.

In the case of tablets, the shape can adopt cylindrical, cuboid or else largely any geometric shapes. In the case of the cylinder, the radius to height ratio can be between 0.25 to 4:1. The compaction pressure can be between 12 and 0.3 $kN/cm^2$. Preference is also given to the multistage compression for the attainment of multiphase tabs. For this, as many layers as are desired are compressed consecutively on one another in a plurality of stages, resulting in a plurality of layers. In the case of two-layer tablets, particular preference is given to a volume ratio of the two layers of from 1:10 to 10:1.

Determination of the Particle Size Distribution by Screen Analysis

The inserts having the desired screens are inserted into a Retsch screening machine. Here, the mesh width of the screen decreases from top to bottom. 50 g of the powder to be investigated are placed onto the widest screen. As a result of the vibratory movement of the screening machine, the powder material is conveyed through the various screens. The residues on these screens are weighed and calculated on the basis of the initial weight of material. The $d_{50}$ value can be calculated from the results. Results which have been determined by this method are indicated by [lacuna] in the examples.

Determination of the Color Values

The colorimeter used is the Luci 100 model from Dr. Lange. The color values are given according to the Hunter system (CIE-LAB system). L values range from 0 (black) to 100 (white), a values from −a (green) to +a (red) and b values from −b (blue) to +b (yellow). The more negative the b value, the more intensively blue the material under investigation.

Preparation of the Test Detergents

The optical brighteners are stirred into a quarter of the amount of alkyl ethoxylate (AE) and mixed with half the amount of soda or bicarbonate in a domestic multimixer (Braun). In a Lödige plowshare mixer, the remaining amount of soda or bicarbonate and the entire amounts of zeolite and polymer are mixed in for 15 minutes at 300 rpm. Half of the AE which remains is then sprayed in over the course of 5 minutes. Then, where appropriate, other phyllosilicate is added and mixed for 10 minutes. The remaining second half of the AE is then sprayed in over the course of a further 5 minutes. Finally, LAS, soap, antifoam, phosphonate and compound with optical brightener are added, and then mixing is carried out for 10 minutes at 300 rpm. In a tumble mixer, the mixture from the Lödige mixer is admixed, with low shear stress, with perborate, TAED, enzymes and alkali metal phyllosilicate compound and mixed for 5 minutes.

Tableting of Detergents

For the tableting, the detergent formulation is mixed and compressed to the appropriate shape using a Matra tableting press. The compaction pressure can be between 12 and 0.3 $kN/cm^2$. The compact has a height of 18 mm and a diameter of 41 mm.

Preparation of the Machine Dishwashing Detergents

The solid components are introduced into a Lödige plowshare mixer and thoroughly mixed. The alkyl ethoxylate is then sprayed on. Finally, enzymes, perfume, percarbonate or perborate and TAED are mixed in.

EXAMPLES

Example 1 (Comparison)

A disintegrant granulate was prepared which comprised 14.91% of cellulose, 84.9% of alkali metal phyllosilicate and 0.19% of Sandolan Blau E-HRL 180 (blue). The L value was 61.4 and the b value −13.23.

Example 2 (Comparison)

900 kg of SKS-6 granulate and 2.7 kg of Sandolan Blau E-HRL 180 (blue) were mixed in a Telschig mixer. The composition of this premix and its analytical data are given in table 1.

Example 3 (Comparison)

In a Schugi mixer (Flexomix 160 model) with downstream batch fluidized bed, the premix from example 2 was mixed with a solution of glycerol and water and afterdried. The composition and the analytical data for the mixture are given in table 1.

Example 4

In a Schugi mixer (Flexomix 160 model) with downstream batch fluidized bed, a dry premix prepared as in example 2 was mixed with a solution of Genapol UD 110 and water and afterdried. The composition and the analytical data of the mixture are given in table 1. L and b values indicate that the color was significantly more intensive than that of the materials of comparative examples 1, 2 and 3.

Example 5

In a Schugi mixer (Flexomix 160 model) with downstream batch fluidized bed, a dry premix prepared as in example 2 was mixed with a solution of Genapol OA 080, water and isopropanol and afterdried. The composition and the analytical data of the mixture are given in table 1. L and b values indicate that the color was significantly more intensive than that of the materials of comparative examples 1, 2 and 3.

Example 6

In a Schugi mixer (Flexomix 160 model) with downstream batch fluidized bed, SKS-6 granulate, colorant and a solution of Genapol UD 110 and water were mixed directly with one another and afterdried. The composition and the analytical data of the mixture are given in table 1. L and b values indicate that the color was significantly more intensive than that of the materials of comparative examples 1, 2 and 3.

Example 7

In a Schugi mixer (Flexomix 160 model) with downstream batch fluidized bed, SKS-6 powder having an average particle diameter of about 140 $\mu$m, colorant and an acidic solution of polycarboxylate (45% strength, acrylic acid/maleic acid copolymer, from Stockhausen) were mixed directly and afterdried. The composition and the analytical data of the mixture are given in table 1. L and b values indicate that the color was significantly more intensive than that of the materials of comparative examples 1, 2 and 3.

Example 8

In a Schugi mixer (Flexomix 160 model) with downstream batch fluidized bed, SKS-6 granulate was mixed with a solution of colorant, Genapol UD 110 and water, and afterdried. The composition and the analytical data of the mixture are given in table 1. L and b values indicate that the color was significantly more intensive than that of the materials of comparative examples 1, 2 and 3.

Example 9

In a freefall mixer from Hauff a premix prepared as in example 2, only using less colorant, was mixed with an increased amount of a solution of Genapol UD 110 and water. The composition and the analytical data of the mixture are given in table 1. L and b values indicate that the color was significantly more intensive than that of the materials of comparative examples 1, 2 and 3.

Example 10

In a Schugi mixer (Flexomix 160 model) with downstream batch fluidized bed, a dry premix prepared as in example 2 only using less colorant, was mixed with an increased amount of a solution of Genapol UD 110. The composition and the analytical data of the mixture are given in table 1. L and b values indicate that the color was significantly more intensive despite the use of less colorant than that of the materials of comparative examples 1, 2 and 3.

Example 11

In a freefall mixer from Hauff, a premix of 900 kg of SKS-6 granulate with 1.8 kg of Sandolan MFBL (green) prepared as in example 2, was mixed, as in example 9, with an increased amount of a solution of Genapol UD 110 and water. The composition and the analytical data are given in table 1.

Example 12

In a freefall mixer from Hauff, a premix of 900 kg of SKS-6 granulate with 1.8 kg of Vitasin chinolingelb 70 (yellow) prepared as in example 2, was mixed, as in example 9, with an increased amount of a solution of Genapol OA 080, isopropanol and water. The composition and the analytical data are given in table 1.

Example 13

In a freefall mixer from Hauff, a premix of 900 kg of SKS-6 granulate with 1.8 kg of Sandolan NBG 125 (brilliant red) prepared as in example 2 was mixed, as in example 9, with an increased amount of a solution of Genapol 2909, isopropanol and water. The composition and the analytical data are given in table 1.

Example 14

A test heavy-duty detergent comprising 0.5% of alkali metal phyllosilicate compound from example 9 was prepared in accordance with the general procedure "Preparation of the test detergents" and the formulation in table 2.

Example 15

A test heavy-duty detergent comprising 0.1% of alkali metal phyllosilicate compound from example 9 was prepared in accordance with the general procedure "Preparation of the test detergents" and the formulation in table 2.

Example 16

A test heavy-duty detergent comprising 1% of alkali metal phyllosilicate compound from example 9 was prepared in accordance with the general procedure "Preparation of the test detergents" and the formulation in table 2.

Example 17

A test heavy-duty detergent comprising 11% of alkali metal phyllosilicate compound from example 9 was prepared in accordance with the general procedure "Preparation of the test detergents" and the formulation in table 2.

Example 18

A test heavy-duty detergent comprising 1% of alkali metal phyllosilicate compound from example 9 was prepared in accordance with the general procedure "Preparation of the test detergents" and the formulation in table 2.

Example 19

A phosphate-containing test heavy-duty detergent comprising 0.2% of alkali metal phyllosilicate compound from example 9 was prepared in accordance with the general procedure "Preparation of the test detergents" and the formulation in table 2.

Example 20

A test color detergent comprising 1% of alkali metal phyllosilicate compound from example 9 was prepared in accordance with the general procedure "Preparation of the test detergents" and the formulation in table 2.

Example 21

A test water softener comprising 15% of alkali metal phyllosilicate compound from example 9 was prepared in accordance with the general procedure "Preparation of the test detergents" and the formulation in table 2.

Example 22

A test stain-removal salt comprising 9% of alkali metal phyllosilicate compound from example 9 was prepared in accordance with the general procedure "Preparation of the test detergents" and the formulation in table 2.

Examples 23 to 25

Detergent tablets were compressed with varying amounts of alkali metal phyllosilicate compound from example 9 in accordance with the general procedures "Preparation of the test detergents", "Tableting of detergents" and the formulations in table 3.

Example 26

A test detergent comprising 0.2% of alkali metal phyllosilicate compound from example 9 was prepared in accordance with the general procedure "Preparation of the test detergents" and the formulation in table 3.

Example 27

A test detergent comprising 1% of alkali metal phyllosilicate compound from example 9 was prepared in accordance with the general procedure "Preparation of the test detergents" and the formulation in table 3.

Example 28

A test detergent comprising 5% of alkali metal phyllosilicate compound from example 9 was prepared in accordance with the general procedure "Preparation of the test detergents" and the formulation in table 3.

Example 29

A test detergent comprising 4% of alkali metal phyllosilicate compound from example 9 was prepared in accordance with the general procedure "Preparation of the test detergents" and the formulation in table 3.

Example 30

A test detergent comprising 7% of alkali metal phyllosilicate compound from example 9 was prepared in accordance with the general procedure "Preparation of the test detergents" and the formulation in table 3.

Example 31

A test detergent comprising 5% of alkali metal phyllosilicate compound from example 9 was prepared in accordance with the general procedure "Preparation of the test detergents" and the formulation in table 3.

Examples 32 to 37

Machine dishwashing detergents comprising varying amounts of alkali metal phyllosilicate compound from example 13 were prepared in accordance with the general procedure "Preparation of the machine dishwashing detergents" and the formulations in table 4.

Example 38

A machine dishwashing detergent gel was prepared by mixing water glass, phosphate, soda, sodium hydroxide, phosphonate, polymer, alkane sulfonate using a dispergator (Ultraturrax, Hanke and Kunkel). Finally, alkali metal phyllosilicate compound from example 11 and sodium hypochlorite are briefly mixed in (Table 4).

TABLE 1

| Examples | | 2 Comp. | 3 Comp. | 4 | 5 | 6 | 7 | 8 | 9 | 10 | 11 | 12 | 13 |
|---|---|---|---|---|---|---|---|---|---|---|---|---|---|
| Use amounts [kg] | | | | | | | | | | | | | |
| Phyllo-Silicate | Granulate | 900 | 900 | 900 | 900 | 900 | — | 900 | 900 | 900 | 900 | 900 | 900 |
| | Powder | — | — | — | — | — | 900 | — | — | — | — | — | — |
| Dye | Sandolan Blau E-HRL 180 (blue) | 2.7 | 2.7 | 2.7 | 2.7 | 2.7 | 3.5 | 2.7 | 1.8 | 1.4 | — | — | — |
| | Sandolan MFBL | — | — | — | — | — | — | — | — | — | 1.8 | — | — |
| | Vitasin ch. gelb 70 (yellow) | — | — | — | — | — | — | — | — | — | — | 1.8 | — |
| | Sandolan NBC 125 | — | — | — | — | — | — | — | — | — | — | — | 1.8 |
| Additive | Glycerol | — | 6.3 | — | — | — | — | — | — | — | — | — | — |
| | Genapol UD110 | — | — | 6.3 | — | 6.3 | — | 6.3 | 14 | 42.3 | 14 | — | — |

TABLE 1-continued

| Examples | 2 Comp. | 3 Comp. | 4 | 5 | 6 | 7 | 8 | 9 | 10 | 11 | 12 | 13 |
|---|---|---|---|---|---|---|---|---|---|---|---|---|
| Genapol OAA 080 | — | — | — | 6.3 | — | — | — | — | — | — | 14 | — |
| Genapol 2909 | — | — | — | — | — | — | — | — | — | — | — | 14 |
| Polycarb-oxylate | — | — | — | — | — | 523 | — | — | — | — | — | — |
| Water | — | 36 | 36 | 36 | 36 | — | 36 | 50 | — | 50 | 50 | 50 |
| Isopropanol | — | — | — | 1.53 | — | — | — | — | — | — | 2.2 | 2.2 |
| Product composition [%] | | | | | | | | | | | | |
| Silicate | 98.3 | 93.9 | 94.1 | 93.9 | 95.2 | 73.3 | 94.0 | 91.9 | 94.0 | 91.9 | 92.1 | 92.0 |
| Colorant | 0.30 | 0.29 | 0.29 | 0.29 | 0.29 | 0.29 | 0.29 | 0.28 | 0.15 | 0.19 | 0.19 | 0.19 |
| Additive | — | 0.7 | 0.7 | 0.7 | 0.7 | 19.2 | 0.7 | 1.4 | 4.5 | 1.4 | 1.5 | 1.5 |
| Water | 1.4 | 5.1 | 4.9 | 5.1 | 3.8 | 7.2 | 5.0 | 6.4 | 1.3 | 6.5 | 6.3 | 6.4 |
| Hunter L | 60.1 | 57.3 | 51.2 | 48.9 | 49.5 | 50.1 | 43.9 | 46.6 | 45.6 | 66.8 | 81.4 | 47.5 |
| Hunter a | −3.34 | −4.63 | −3.6 | −2.95 | −4.96 | −5.01 | −3.34 | −3.31 | −3.34 | −25 | 4.9 | 51.8 |
| Hunter b | −13.5 | −12.9 | −22.7 | −23.2 | −21.6 | −22.8 | −23.4 | −26.7 | −26.1 | 8 | 24.2 | 14.6 |
| $d_{50}$ [mm] | 0.781 | 0.765 | 0.635 | 0.732 | 0.74 | 0.647 | 0.687 | 0.704 | 0.722 | 0.650 | 0.675 | 0.643 |
| >1.4 mm [%] | 9.8 | 9.01 | 2.9 | 5 | 7.2 | 4.4 | 4.3 | 5.8 | 8.7 | 4.5 | 6.3 | 3.9 |
| <0.25 mm [%] | 0.41 | 0.8 | 7.1 | 3.1 | 4 | 7.6 | 9.4 | 6.5 | 1.4 | 9.7 | 8.8 | 9.9 |

TABLE 2

| Examples | 14 [%] | 15 [%] | 16 [%] | 17 [%] | 18 [%] | 19 [%] | 20 [%] | 21 [%] | 22 [%] |
|---|---|---|---|---|---|---|---|---|---|
| Zeolite A | 34.5 | 24 | 24 | 24 | — | — | 30 | 40 | — |
| Phosphate 1 | — | — | — | — | — | 25 | — | — | — |
| SKS-6 | — | 10.9 | 10.0 | — | 50 | 10 | 10 | — | — |
| cpd. of ex. 9 | 0.5 | 0.1 | 1.0 | 11 | 1 | 0.2 | 1 | 15 | 9 |
| Polymer 1 | 3 | 3 | 3 | 3 | 3 | — | 7 | 7 | — |
| Soda | 16 | 16 | 16 | 16 | — | — | — | 15 | 9 |
| Bicarbonate | — | — | — | — | 9 | — | 18 | 5 | — |
| Perborate mh | 18 | 18 | 18 | 18 | | — | — | — | — |
| Perborate th | — | — | — | — | — | 20 | — | — | — |
| Percarbonate | — | — | — | — | 18 | — | — | — | 40 |
| TAED 1 | 5 | 5 | 5 | 5 | 5 | — | — | — | 13 |
| LAS | 9 | 9 | 9 | 9 | — | 6.7 | 8 | — | 5 |
| AE 1 | 4 | 4 | 4 | 4 | 4 | 2.0 | 10 | 2 | — |
| AE 2 | 4 | 4 | 4 | 4 | 4 | — | — | — | — |
| Soap | 1 | 1 | 1 | 1 | 1 | — | 1 | 2 | 1 |
| Antifoam | 1 | 1 | 1 | 1 | 1 | 0.6 | 1 | — | — |
| Enzyme 1 | 1.5 | 1.5 | 1.5 | 1.5 | 1.5 | 0.6 | 1.5 | — | — |
| Enzyme 3 | 1.5 | 1.5 | 1.5 | 1.5 | 1.5 | 0.6 | 1.5 | — | — |
| Opt. brightener | 0.5 | 0.5 | 0.5 | 0.5 | 0.5 | 0.2 | — | — | — |
| Phosphonate 1 | 0.5 | 0.5 | 0.5 | 0.5 | 0.5 | 0.1 | 0.2 | — | — |
| Citric acid | — | — | — | — | — | — | 2 | 5 | — |
| PVP | — | — | — | — | — | — | 1 | — | — |
| SRP | — | — | — | — | — | — | 0.8 | — | — |
| CMC | — | — | — | — | — | — | 1 | — | — |
| Sulfate | — | — | — | — | — | 34 | 7 | 9 | 23 |
| Dosing [g] | 72 | 72 | 72 | 72 | 72 | 135 | 72 | 30 | 40 |

TABLE 3

| Examples | 23 [%] | 24 [%] | 25 [%] | 26 [%] | 27 [%] | 28 [%] | 29 [%] | 30 [%] | 31 [%] |
|---|---|---|---|---|---|---|---|---|---|
| Zeolite A | — | 15 | 15 | 31 | 31 | 31 | 30 | — | — |
| SKS-6 | 30 | 15 | 11 | 15 | 10 | | — | 5 | — |
| cpd. of ex. 9 | 0.1 | 1 | 5 | 0.2 | 1 | 5 | 4 | 7 | 5 |
| Polymer 1 | 4 | 4 | 4 | 5 | 5 | 5 | 3 | 2 | 2 |
| Soda | 12 | 12 | — | 5 | 10 | 15 | 40 | 29 | 76 |
| Bicarbonate | 5 | 5 | 14 | — | — | — | — | — | — |
| Perborate mh | — | — | — | — | — | — | — | — | 3 |

TABLE 3-continued

| Examples | 23 [%] | 24 [%] | 25 [%] | 26 [%] | 27 [%] | 28 [%] | 29 [%] | 30 [%] | 31 [%] |
|---|---|---|---|---|---|---|---|---|---|
| Perborate th | — | — | — | — | — | — | — | — | 2 |
| Percarbonate | 12 | 12 | 12 | — | — | — | — | — | — |
| TAED 1 | 4 | 4 | 4 | — | — | — | — | — | — |
| LAS | 7 | 7 | 7 | 10 | 30 | — | 7 | 6 | — |
| Alkanesulfonate | — | — | — | — | — | — | 9 | 5 | 8 |
| AE 1 | — | — | — | 15 | 4 | 18 | 3 | — | 4 |
| AE 2 | — | — | — | 10 | 3 | — | — | — | — |
| AE 3 | 4 | 4 | 3 | — | — | — | — | — | — |
| Soap | — | — | — | — | — | 13 | — | — | — |
| Enzyme 1 | — | — | — | 1.5 | 0.5 | 0.5 | 0.2 | — | — |
| Enzyme 3 | — | — | — | 1.5 | 0.5 | 0.5 | 0.3 | — | — |
| Opt. brightener | — | — | — | — | 0.5 | — | — | — | — |
| Citric acid | 6 | 6 | 15 | — | — | — | — | — | — |
| Sulfate | — | — | 10 | 5.8 | 4.5 | 12 | 4 | — | — |
| Chloride | — | — | — | — | — | — | — | 46 | — |
| Cellulose | — | 7 | — | — | — | — | — | — | — |
| Acetate th | 15.9 | 8.0 | — | — | — | — | — | — | — |
| Dosing [g] | 2*40 | 2*40 | 2*40 | 0.5 g/l | 0.5 g/l | 0.5 g/l | 80 | 80 | 150 |

TABLE 4

| Examples | 32 [%] | 33 [%] | 34 [%] | 35 [%] | 36 [%] | 37 [%] | 38 [%] |
|---|---|---|---|---|---|---|---|
| Phosphate 2 | — | — | 25 | 47 | 20 | — | — |
| Phosphate 3 | — | — | — | — | — | — | 22 |
| Metasilicate ph | — | — | — | — | 47 | — | — |
| SKS-6 | 19.5 | 4.0 | 13 | — | — | — | 5 |
| cpd. of ex. 9 | 0.5 | 1 | 2 | 8 | 3 | 80 | 1 |
| Soda | 23 | 33 | 30 | 25 | 17 | — | 1 |
| Sodium hydroxide | — | — | — | — | 8 | — | 1 |
| Citrate th | 30 | 35 | — | — | — | — | — |
| Percarbonate | 10 | 10 | — | — | — | 18 | — |
| Perborate mh | — | — | 10 | 10 | — | — | — |
| NaDCC | — | — | — | — | 1 | — | — |
| Polymer 2 | 7 | 7 | 7 | 3 | — | — | — |
| Polymer 3 | — | — | — | — | — | — | 2 |
| TAED 2 | 5 | 5 | 2 | 2 | — | — | — |
| Enzyme 2 | 1 | 1 | 1 | 1 | — | — | — |
| Enzyme 4 | 2 | 2 | 2 | 2 | — | — | — |
| AE 4 | 1.5 | 1.5 | 1.5 | 1.5 | 4 | 2 | — |
| Perfume | 0.5 | 0.5 | 0.5 | 0.5 | — | — | — |
| Phosphonate 2 | — | — | — | — | — | — | 1 |
| Alkanesulfonate | — | — | — | — | — | — | 2 |
| Water glass | — | — | — | — | — | — | 36 |
| Hypochlorite | — | — | — | — | — | — | 9 |
| Sulfate | — | — | 6 | — | — | — | — |
| Water | — | — | — | — | — | — | 20 |
| Dosing [g] | 20 | 20 | 20 | 20 | 2 g/l | 60 | 40 |

Substances Used

| | |
|---|---|
| AE 1: | Genapol OAA 080, Clariant |
| AE 2: | Genapol OAA 040, Clariant |
| AE 3: | Genagen 81MEE100, Clariant |
| AE 4: | Genapol 2822, Clariant |
| Acetate th: | Sodium acetate trihydrate, Riedel-de Haen |
| Alkanesulfonate: | Hostapur SAS 60, Clariant |
| Antifoam: | 11.Pwd.ASP3, Wacker |
| Bicarbonate: | Solvay |
| Citrate th: | Trisodium citrate trihydrate, Jungbunzlauer |
| Citric acid: | from Jungbunzlauer |
| Cellulose: | Arbocell, Rettenmaier |
| CMC: | Tylose 2000, Clariant |
| Enzyme 1: | Termamyl 60T, Solvay Enzymes |
| Enzyme 2 | Termamyl 120T, Solvay Enzymes |
| Enzyme 3: | Savinase 6.0 TW, Solvay Enzymes |

-continued

| | |
|---|---|
| Enzyme 4 | Savinase 6.0 TW, Solvay Enzymes |
| Hypochlorite: | Sodium hypochlorite, Celanese GmbH |
| LAS: | Marion ARL, Hüls |
| Metasilicate ph: | Metasilicate pentahydrate, van Baerle |
| NaDCC: | Sodium dichlorodiisocyanurate, Olin Chemicals |
| Sodium chloride | Merck KGaA |
| Sodium hydroxide: | Microprills 100%, Riedel-de Haen |
| Optical brightener: | Tinopal CBS-X, Ciba |
| Perfume: | Lemon perfume 78122D, Orissa |
| Perborate mh: | Perborate monohydrate, Degussa |
| Perborate th: | Perborate tetrahydrate, Degussa |
| Percarbonate: | Oxyper C, Solvay Interox |
| Phosphate 1: | Sodium tripolyphosphate from Thermphos Intl. |
| Phosphate 2: | Makrophos 1018, BK Giulini |
| Phosphate 3: | Thermphos NW coarse |
| Phosphonate 1: | Dequest 2041, Monsanto |
| Phosphonate 2: | Dequest 200, Monsanto |
| Polymer 1: | Sokalan CP5 powder, BASF |
| Polymer 2: | Sokalan CP45, BASF |
| Polymer 3: | Sokalan CP5 liquid, BASF |
| PVP: | Polyvinyl pyrrolidone, Sokalan HP50, BASF |
| Soap: | Liga base soap HM11E |
| Soda: | Heavy soda, Matthes & Weber |
| SRP: | Soil release Polymer, SRC 1, Clariant |
| Sulfate: | from Solvay |
| TAED 1: | TAED 4049, Clariant |
| TAED 2: | TAED 3873, Clariant |
| Water glass: | 45.5% of active substance, Modulus 2.0, Clariant France |
| Zeolite A: | Wessalith P, Degussa |

What is claimed is:

1. A granular alkali metal phyllosilicate compound which comprises 68–99.79% by weight of alkali metal phyllosilicate, 0.01–2% by weight of colorant, and 0.1–15% by weight of an additive.

2. The granular alkali metal phyllosilicate compound as claimed in claim 1, which comprises 68–99.79% by weight of alkali metal phyllosilicate, 0.01–2% by weight of colorant, 0.1–15% by weight of additives and 0.1–15% by weight of water.

3. The granular alkali metal phyllosilicate compound as claimed in claim 1, which comprises 84–98.95% by weight of alkali metal phyllosilicate, 0.05–1% by weight of colorant, 0.5–5% by weight of additives and 0.5–10% by weight of water.

4. The granular alkali metal phyllosilicate compound as claimed in claim 1, wherein the colorant is an oxidation-stable and/or alkali-stable colorant and/or a pigment.

5. The granular alkali metal phyllosilicate compound as claimed in claim 1, wherein the additives are alkyl alkoxylate, gluconamides, alkyl polyglycosides, alkyl ester alkoxylates, oligoglycols, polyglycols, monoalkyl glycol ethers, monoalkyl oligoglycol ethers, monoalkyl polyglycol ethers, dialkyl glycol ethers, dialkyl oligoglycol ethers, dialkyl polyglycol ethers, oligocarboxylates and/or polycarboxylates.

6. The granular alkali metal phyllosilicate compound as claimed in claim 1, wherein the alkyl alkoxylates are alkyl ethoxylates and/or EO-PO alkoxylates.

7. The granular alkali metal phyllosilicate compound as claimed in claim 1, which has an average particle diameter of from 400 to 900 $\mu$m.

8. A process for the preparation of a granular alkali metal phyllosilicate compound as claimed in claim 1, which comprises mixing an alkali metal phyllosilicate with a colorant and then spraying on an additive and, if desired, afterdrying.

9. The process for the preparation of a granular alkali metal phyllosilicate compound as claimed in claim 7, which comprises spraying on the additive in a mixture with water and/or a solubility promoter and, if desired, afterdrying.

10. A detergent and cleaner comprising a granular alkali metal phyllosilicate compound as claimed in claim 1.

11. The detergent and cleaner as claimed in claim 10, which comprises 0.1 to 80% by weight of the granular alkali metal phyllosilicate compound 0 to 92% by weight of cobuilders 0 to 37% by weight of surfactant 0 to 53% by weight of bleaching-active agents 0 to 30% by weight of further phyllosilicate 0 to 46% by weight of electrolyte donor.

12. The detergent and cleaner as claimed in claim 10 in tablet form.

* * * * *